US005395716A

United States Patent [19]

Schade et al.

[11] Patent Number: 5,395,716

[45] Date of Patent: Mar. 7, 1995

[54] ELECTROPHOTOGRAPHIC RECORDING MATERIAL

[75] Inventors: Klaus Schade; Alfred Kottwitz; Gunnar Suchaneck, all of Dresden; Jens-Peter Mönch, Bannewitz; Sabine Dreihöfer, Warstein-Sichtigvor; Manfred Lutz, Warstein-Belecke, all of Germany

[73] Assignee: Licentia Patent-Verwaltungs-GmbH, Frankfurt, Germany

[21] Appl. No.: 43,775

[22] Filed: Apr. 6, 1993

[30] Foreign Application Priority Data

Apr. 11, 1992 [DE] Germany ..... 42 12 230.9

[51] Int. Cl.[6] ..... G03G 15/04

[52] U.S. Cl. ..... 430/65; 430/60; 430/66; 430/67; 430/84

[58] Field of Search ..... 430/65, 67, 60, 66, 430/84

[56] References Cited

U.S. PATENT DOCUMENTS 4,932,859 6/1990 Yagi et al. ..... 430/66

FOREIGN PATENT DOCUMENTS

3600419A1 7/1986 Germany .

*Primary Examiner*—Marion E. McCamish
*Assistant Examiner*—Mark A. Chapman
*Attorney, Agent, or Firm*—Spencer, Frank & Schneider

[57] ABSTRACT

An improved electrophotographic recording material of the type comprising an electrically conductive substrate having a blocking layer composed of an amorphous material including silicon atoms, hydrogen atoms and carbon atoms disposed on the substrate, and a photoconductive layer of hydrogenated amorphous silicon disposed on the blocking layer. The photoconductive layer includes carbon atoms, the blocking layer and the photoconductive layer are doped with an element of Group III of the Periodic Table of Elements, and the ratio of the carbon percentage to the percentage of the element of Group III of the Periodic Table of Elements is the same in the blocking layer and in the photoconductive layer.

20 Claims, 2 Drawing Sheets

ELECTROPHOTOGRAPHIC RECORDING MATERIAL

REFERENCE TO RELATED APPLICATIONS

This application claims the priority of Federal Republic of Germany application Serial No. P 42 122 30.9 filed Apr. 11th, 1992, which is incorporated herein by reference.

BACKGROUND OF THE INVENTION

The present invention relates to an electrophotographic recording material including an electrically conductive substrate, a blocking layer that is disposed on the substrate and is composed of an amorphous material containing silicon atoms, hydrogen atoms and carbon atoms, and a photoconductive layer of hydrogenated amorphous silicon adjacent the blocking layer.

Such an electrophotographic recording material is disclosed in German Patent 3,136,141, corresponding to U.S. Pat. No. 4,394,425. The blocking layer prevents charge carriers from escaping from the conductive substrate into the photoconductive layer. On the other hand, the blocking layer has such a configuration that it enables charge carriers produced by the radiation of light into the photoconductive layer to travel through the blocking layer to the substrate. These characteristics of the blocking layer are essentially realized in that the amorphous silicon in the blocking layer has a carbon content of 60 to 90 atom %. However, one of the drawbacks of the prior art electrophotographic recording material is that the surface potential experiences a drop in dark discharge that is too rapid and, particularly under the influence of a very intensive irradiation of light, degradation, and thus a change in the photoconductive layer is observed during the discharging process. This degradation essentially results in worsening of the contrast of the resulting image.

SUMMARY OF THE INVENTION

It is an object of the present invention to make available an electrophotographic recording material of the above-defined type which not only has only a slight drop in dark discharge, but also ensures high-contrast images.

The above object generally is achieved by the present invention by an electrophotographic recording material comprising an electrically conductive substrate, a blocking layer composed of an amorphous material containing silicon atoms, hydrogen atoms and carbon atoms disposed on the substrate, and a photoconductive layer of hydrogenated amorphous silicon disposed on the blocking layer; and wherein the photoconductive layer contains carbon atoms, the blocking layer and the photoconductive layer are doped with an element of Group III of the Periodic Table of Elements, and the ratio of the carbon percentage to the percentage of the element of Group III of the Periodic Table of Elements is the same in the blocking layer and in the photoconductive layer.

It is of particular advantage if this ratio lies within a range from about 10 to about 50 and the ratio of the carbon percentage to the silicon percentage in the photoconductive layer is from about $2\times10^{-3}$ to about $8\times10^{-3}$.

A particular advantage of the electrophotographic recording material is also that, in order to reduce abrasion, the photoconductive layer can be coated with a cover layer of amorphous silicon and hydrogen and carbon without the above-mentioned advantages being significantly jeopardized. In particular, care must be taken, by appropriately adapting the hydrogen and carbon content of the cover layer, that the incident light is absorbed only slightly in the cover layer.

The significant features of the invention will be described below in greater detail with reference to the drawing figures.

DETAILED DESCRIPTION OF THE PREFERRED EMBODIMENT

Figure 1:
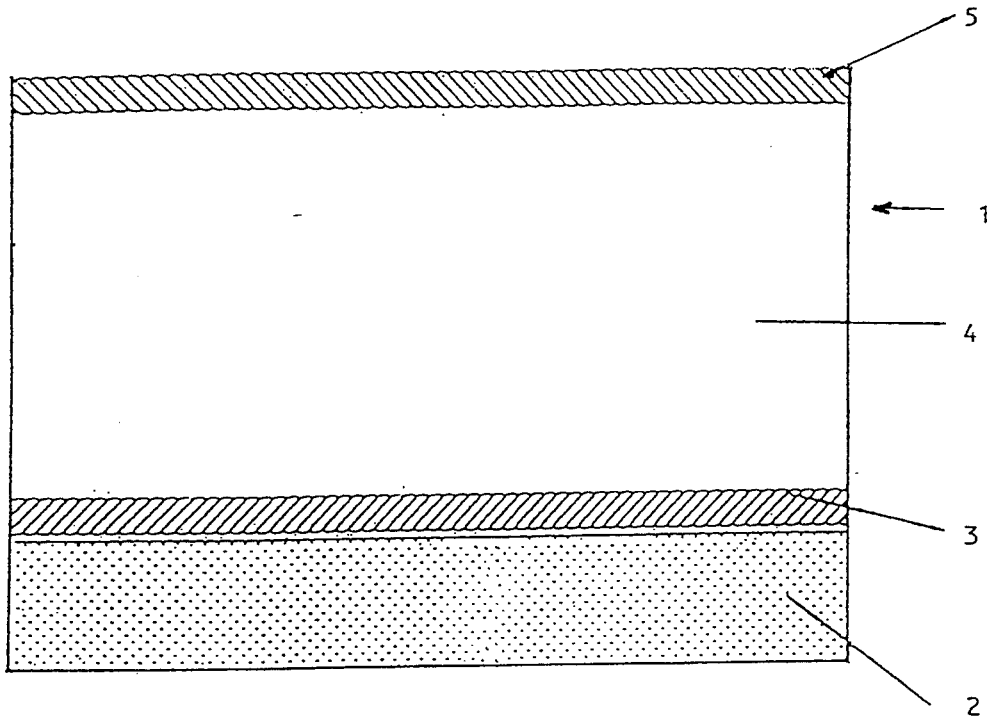
FIG. 1 is a cross-sectional view of an electrophotographic recording material according to a preferred embodiment of the invention wherein the material layers are applied to a conductive cylindrical substrate.

The electrophotographic recording material 1 according to the embodiment of FIG. 1 includes a drum-shaped substrate 2 of aluminum on which three layers are disposed, namely a blocking layer 3, a photoconductive layer 4 and a cover layer 5. All three of the layers contain carbon and hydrogen in addition to the basic silicon material, the blocking layer 3 and the photoconductive layer 4 each contain an element from Group III of the Periodic Table of Elements, particularly boron, and the cover layer 5 selectively may or may not contain the Group III element, e.g. boron. Moreover, as indicated above, the blocking layer 3 and the photoconductive layer 4 both have the same ratio of the carbon percentage to the percentage of the Group III element, particularly boron. Preferably this ratio lies within a range of about 10 to about 50, and the ratio of the carbon percentage to the silicon percentage in the photoconductive layer 4 is from about $2\times10^{-3}$ to about $8\times10^{-3}$. In addition, when the cover layer 5 is doped with a Group III element, the cover layer 5 preferably has a ratio of its carbon percentage to its percentage of the Group III element which is the same as the corresponding ratio in the photoconductive layer 4.

The thickness of the photoconductive layer 4 is a function of the selected charging potential and lies in a thickness range from about 10 to about 50 μm. The concentration of the Group III element, particularly boron, is set so that the greatest possible, i.e., maximum, dark resistance is realized. The characteristics of the electrophotographic recording material can be further improved in that, in its boundary region toward the cover layer 5, the photoconductive layer 4 has a carbon and/or boron content that is five to fifty times less than that at the boundary region toward the blocking layer 3. The characteristics of the blocking layer 3 can be set particularly optimally if the blocking layer 3 has a carbon content of about 0.5 to about 5 atom % with a thickness range from about 0.03 to about 0.3 μm being favorable. Preferably, the thickness of the blocking layer 3 is about 0.2 μm. The concentration and thickness can be optimized by employing the relationship that the product of the layer thickness and the boron concentration in the blocking layer 3 should lie within a range from about $3\times10^{13}$ to about $3\times10^{15}$ $cm^{-2}$.

As already mentioned, the cover layer 5 should have such parameters that, on the one hand, absorption is as low as possible and, on the other hand, the electrical characteristics of the photoconductive layer 4 and of the blocking layer 3 are not adversely affected. This can be accomplished in that a carbon content of about 40 to about 70 atom % is set for the cover layer 5. With respect to absorption, a band spacing from about 2.0 to 2.3 eV appears to be sufficient. For this purpose, the hydrogen content of the cover layer 5 should be about 20 to 40 atom %. If, however, the sensitivity of the electrophotographic recording material toward shorter wavelengths is improved to beyond the band spacing, the carbon content in the cover layer 5 must be increased. If the thickness is less than about 0.05 μm, the degradation of the photoconductor is increased. A thickness greater than about 0.3 μm, however, worsens the sensitivity of photoconductive layer 4. Optimum results can be realized in a layer thickness range of about 0.1 to 0.2 μm.

Figure 2:
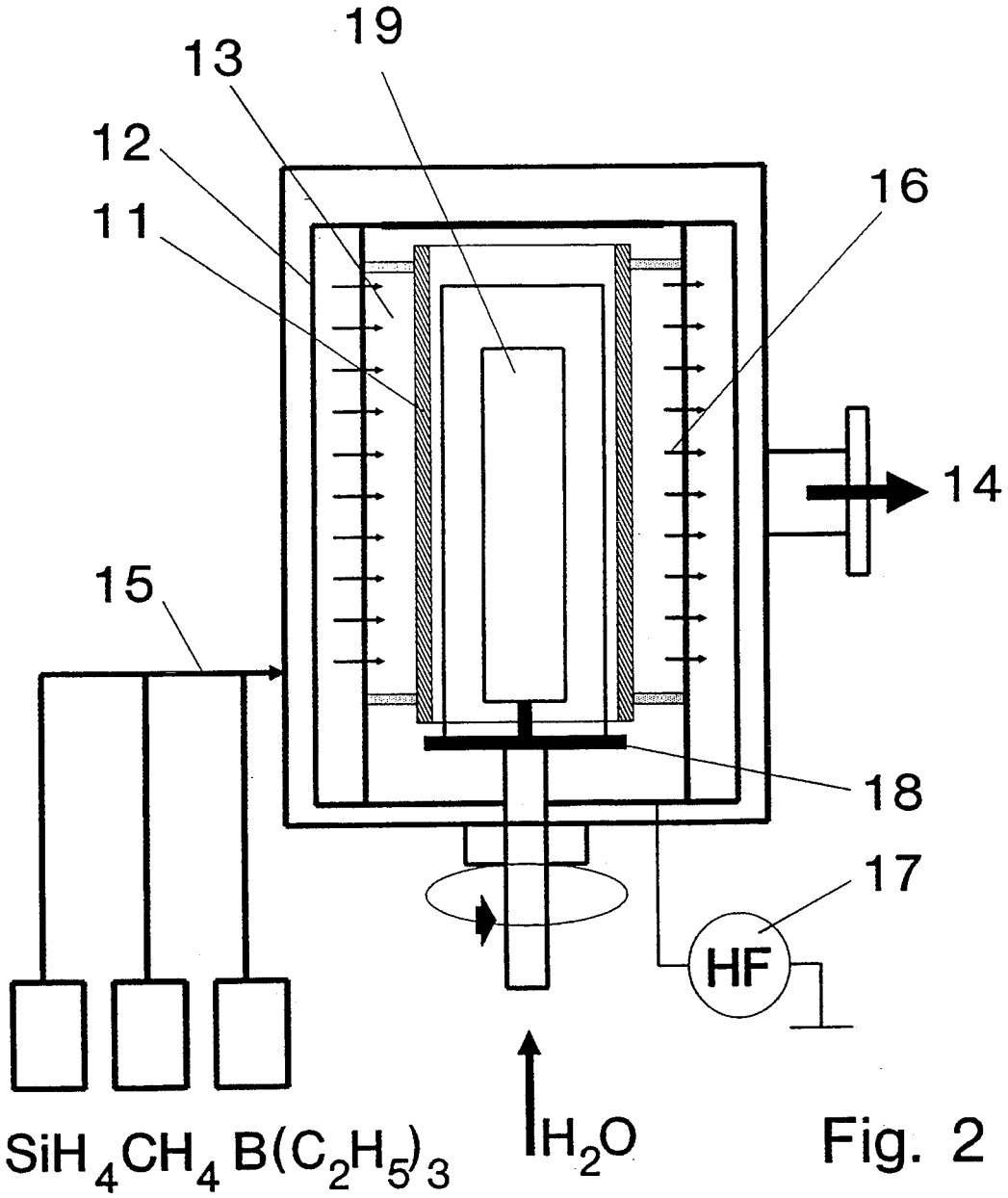
FIG. 2 schematically shows a device for producing the layers of the electrophotographic recording material of FIG. 1.

FIG. 2 shows a device that can be used to produce an electrophotographic recording material composed of a blocking layer, a photoconductive layer and a cover layer disposed on a conductive substrate. With reference to this device, a specific embodiment will now be described in greater detail. An aluminum drum 1 having a wall thickness of about 4 mm serves as the substrate which is fastened to the substrate holder 18. The cleaning and pretreatment of the drum 1 is effected in the manner customary and known in electrophotography.

To coat the cylindrical substrate or drum 11, it is initially heated to a predetermined temperature by the heater 19. The precipitation is effected by means of a gas discharge 13 between the electrode 12 and the drum 11. The gas discharge 13, in the illustrated embodiment, is operated as a high frequency generated by the high frequency (HF) source 17. The working gas flows in through a gas inlet 5 and is discharged by means of a vacuum pump (not shown) at a gas outlet 14. The gas discharge is thus performed with a flowing working gas 16, with a predetermined discharge pressure being set by the flow at gas inlet 15 and by the evacuation at the gas outlet 14. For a substrate temperature of 250° C., this pressure may lie at 40 Pa.

Initially, a blocking layer 3 is precipitated to a layer thickness of about 0.2 μm, with a ratio of carbon to boron of about 40 being set by the gas concentration at the gas inlet 35. The boron concentration in the blocking layer 3 is about $2\times10^{14}$ $cm^{-2}$ with respect to the surface area. The working gas is composed of a mixture of monosilane and triethyl boron. Once the blocking layer 3 has been precipitated, the mixing ratio of the working gas is changed such that for a carbon to boron ratio of 40, a carbon concentration of 0.5 atom % is set. The photoconductive layer 4 is then precipitated. With a layer thickness of 25 μm for the photoconductive layer 4, the photoconductor can be charged to a maximum surface potential of more than 900 volts.

To precipitate the cover layer 5, a mixture of monosilane and methane is introduced into the recipient in such a ratio that an optical band spacing of about 2.1 eV results for a hydrogen percentage of about 35 atom %. Without significantly adversely influencing the blue sensitivity, sufficient passivation can be realized for the cover layer 5 with a layer thickness of about 0.15 μm.

The invention now being fully described, it will be apparent to one of ordinary skill in the art that any changes and modifications can be made thereto without departing from the spirit or scope of the invention as set forth herein.

What is claimed is:

1. An electrophotographic recording material, comprising:

an electrically conductive substrate;

a blocking layer composed of an amorphous material including silicon atoms, hydrogen atoms and carbon atoms disposed on said electrically conductive substrate; and a photoconductive layer composed of hydrogenated amorphous silicon including carbon atoms disposed on said blocking layer, wherein said blocking layer and said photoconductive layer are doped with an element of Group III of the Periodic Table of Elements, and wherein said blocking layer and said photoconductive layer each have a ratio of content of carbon to content of the element of Group III of the Periodic Table of Elements which is the same.

2. An electrophotographic recording material as defined in claim 1, wherein said ratio of content of carbon to content of the element of Group III of the Periodic Table of Elements lies within a range from about 10 to about 50.

3. An electrophotographic recording material as defined in claim 2, wherein said photoconductive layer has a ratio of carbon content to silicon content which lies within a range from about $2\times10^{-3}$ to about $8\times10^{-3}$.

4. An electrophotographic recording material as defined in claim 3, wherein said blocking layer has a thickness in a range from about 0.03 to about 0.3 μm.

5. An electrophotographic recording material as defined in claim 4, wherein said thickness of said blocking layer is approximately 0.2 μm.

6. An electrophotographic recording material as defined in claim 3, wherein the carbon content in said blocking layer is about 0.5 to about 5 atom %.

7. An electrophotographic recording material as defined in claim 6, wherein said photoconductive layer has a thickness in a range from about 10 to about 50 μm.

8. An electrophotographic recording material as defined in claim 6, wherein said carbon in said photoconductive layer is distributed in an irregular fashion.

9. An electrophotographic recording material as defined in claim 8, wherein the carbon content in said photoconductive layer decreases in a direction from said blocking layer.

10. An electrophotographic recording material as defined in claim 9, wherein the carbon content in an edge region of said photoconductive layer facing away from said blocking layer is about 10 to 50 times less than in an edge region of said photoconductive layer adjacent to said blocking layer.

11. An electrophotographic recording material as defined in claim 1, further comprising a cover layer of amorphous material composed of silicon, carbon and hydrogen disposed on said photoconductive layer.

12. An electrophotographic recording material as defined in claim 11, wherein said cover layer includes about 40 to about 70 atom % carbon and about 20 to about 40 atom % hydrogen.

13. An electrophotographic recording material as defined in claim 11, wherein said amorphous material of said cover layer has an energy band spacing in a range from about 2 to about 2.3 eV.

14. An electrophotographic recording material as defined in claim 11, wherein said cover layer has a thickness in a range from about 0.05 to about 0.3 μm.

15. An electrophotographic recording material as defined in claim 14, wherein said thickness of said cover layer is in a range from about 0.1 to about 0.2 μm.

16. An electrophotographic recording material as defined in claim 11, wherein said cover layer is doped with an element of Group III of the Periodic Table of Elements.

17. An electrophotographic recording material as defined in claim 16, wherein said cover layer has a ratio of content of carbon to content of the element of Group III which is the same as in said photoconductive layer.

18. An electrophotographic recording material as defined in claim 17, wherein said element of Group III of the Periodic Table of Elements is boron.

19. An electrophotographic recording material as defined in claim 18, wherein said blocking layer has a product of layer thickness and boron concentration which lies in a range from about $3\times10^{13}$ to about $3\times10^{15}$ $cm_{-2}$.

20. An electrophotographic recording material as defined in claim 1 wherein said element of Group III of the Periodic Table of Elements is boron and wherein said blocking layer has a product of layer thickness and boron concentration which lies in a range from about $3\times10^{13}$ to about $3\times10^{15}$ $cm_{31\ 2}$.

* * * * *